US005649647A

United States Patent [19]

Kodarar

[11] Patent Number: 5,649,647

[45] Date of Patent: Jul. 22, 1997

[54] TRANSFER PUMP FOR CHLORINATED LIQUID

[76] Inventor: Joseph Kodarar, 32 First St., Waterford, N.Y. 12188

[21] Appl. No.: 513,442

[22] Filed: Aug. 10, 1995

[51] Int. Cl.[6] ..... B67D 5/06

[52] U.S. Cl. ..... 222/204; 222/205; 222/383.3; 222/416

[58] Field of Search ..... 222/158, 204, 222/205, 383.3, 386, 388, 416

[56] References Cited

U.S. PATENT DOCUMENTS

| | | | |
|---|---|---|---|
| 645,101 | 3/1900 | Jackson . | |
| 720,492 | 2/1903 | Sedberry . | |
| 2,183,370 | 12/1939 | Selitzky | 225/35 |
| 2,510,159 | 6/1950 | Wiczer | 222/205 X |
| 3,430,813 | 3/1969 | Gilmont | 222/383.3 X |
| 3,653,556 | 4/1972 | Moran et al. | 222/383.3 X |
| 4,695,176 | 9/1987 | Simonette et al. | 401/144 |
| 4,732,503 | 3/1988 | Bader et al. | 401/197 |
| 5,094,366 | 3/1992 | Lin | 222/416 |

FOREIGN PATENT DOCUMENTS

| | | | |
|---|---|---|---|
| 349763 | 3/1922 | Germany | 222/383.3 |

*Primary Examiner*—Joseph Kaufman
*Attorney, Agent, or Firm*—Fredric Morelle

[57] ABSTRACT

A cylindrical piston pump with an inlet suction line and outlet discharge port. The pump is capable of lifting chlorine-containing fluid from out a portable container and, with little inducement save gravity, automatically transferring the liquid to a desired, generally lower location. The automatic transfer is effected by flap or analogous valve control; while semi-automatic is effected by rotary or shuttle, manually actuated valves. Outflow is enhanced by gravity, spring return of the piston and/or connection of the discharge line to a fluid entrainment assembly.

14 Claims, 2 Drawing Sheets

TRANSFER PUMP FOR CHLORINATED LIQUID

BACKGROUND OF THE INVENTION

1. Field of the Invention

This invention relates generally to liquid measuring and dispensing devices and, particularly, to a manual pump which is designed to take up from a container an amount of chlorine-containing liquid (hereafter, "chlorine" or "chlorine liquid"), measure it and dispense it, in metered fashion, to a water reservoir.

2. Relevant Art

Currently in the art, it is the practice of swimming pool operators, or managers of small water reservoirs, to pour chlorine (the term used hereafter to designate a cholorine-containing liquid) from bulk containers into managable cups or buckets and thereafter distribute it directly into the pool or its water circulation system. The process, at times and under some circumstances, can be messy, inconvenient, time-consuming and often fraught with the possibility of spillage. My transfer pump eliminates the aforesaid negatives and provides a positive method and apparatus which, above all, expedites the pool chlorination process and greatly simplifies the task. Fluid transfer pumps per se are known in the art and abound in almost unlimited variety. After a thorough search in U.S. patent records, I am assured that my invention is unique and particularly suited for accomplishing the aforesaid task.

one particularly relevant patent is that issued to Selitzky in 1939, U.S. Pat. No. 2,183,370. This patent shows a single piston pump, all but the handle and discharge spout, immersed in the fluid container. No measument device accompanies the apparatus and a ball-in-seat check valve mechanism is a two part, set-apart subassembly. The full cycle of intake/exhaust must be manually driven with the latter portion requiring that the liquid be lifted a second time. The design and operation of '370 is analogous to a bicycle tire pump. It is important to note that the immersed cylinder/piston/valve unit of this disclosure does not (technically) lift liquid from out a lower reservoir—it requires that the pump and discharge assembly be attached to a pre-designed cover and that it be fixed over the entire liquid container.

Another relavant patent is U.S. Pat. No. 720,492, issued to Sedberry in 1903. This disclosure shows a pump of the piston/cylinder type that is fed from a liquid supply disposed at the level of, or higher than, the pump itself. A rotary valve requiring manual actuation, for fill and exhaust, allows liquid outflow from the cylinder base. I term this latter effect "allows" because outflow will naturally take place through gravity, if the piston is not constrained in its upward position. I employ this feature in my invention.

U.S. Pat. No. 645,101, issued in 1900 to Jackson, discloses not a pump, but a measuring faucet. This cylindrical, see-through container receives its charge through a petcock-controlled, higher reservoir-fed line that communicates with the container through a singly ported rotary check valve that is located at the container's base.

Most relevant, because of the valving shown in addition to the fact that it is a single-stroke (uptake) mechanism, is that apparatus disclosed in U.S. Pat. No. 4,732,503, issued in 1988. The reservoir fluid dispenser shown therein is a single-stroke uptake device having a rotary control valve for selecting intake and dispensation modes. However, an exhaust stroke must be applied after the manual valve is moved to the dispensing mode. Also disclosed, and incorporated by terence in this work, are alternate valve concepts such as discrete position and spring-biased shuttle valves.

A precursor to '503 is U.S. Pat. No. 4,695,176, issued in 1987. It discloses similar art, but introduces the duck-bill valve. This valve is applicable to my invention also.

Although the aforesaid disclosures show pertinent parts of my invention, none appear to teach my combination of elements that enable me to achieve the results that I desire and reveal in the hereinafter given SUMMARY etc. I have overcome limitations such as a stationary fluid container might impose; and I have provided a mechanism that is easily attached to/detached from the container. Additionally, a flap or duck-bill valve, fluid flow check mechanism will prove most advantageous in the desired working enviornment, lending cost savings, reliability and ease of use to the invention.

3. Incorporation by Reference

Having special relevance because of the piston-in-cylinder including sealing methodology, check valving including detailed drawings of rotary, petcock, duck-bill and shuttle valves, and various container connections and distribution technologies, the following documents, all U.S. patents, are incorporated herein by reference: U.S. Pat. Nos. 4,732,503; 4,695,176; 2,183,370; 720,492; and U.S. Pat. No. 645,101.

SUMMARY OF THE INVENTION

The chlorine pump includes a cylinder made of chlorine-impervious material. The cylinder is either transparent or is attended by a sight gauge, known in the art, to afford a view of its liquid content. A piston is the major working part and is closely, but movably fitted inside the cylinder. A piston shaft, terminated in a handle device ascends from a vertically disposed cylinder/piston assembly through a vented cylinder cap. At the base of the cylinder is a check valve subassembly that allows a fluid uptake from a subtended chlorine liquid storage unit when the piston is drawn upwardly, and allows a fluid outflow from the cylinder to a position distal the storage unit. Depending on the type of valve used, outflow is effected by any one of the following modalities; gravity: gravity with coil spring assist (the spring is positioned about the piston shaft between the cap and the piston); gravity with fluid entrainment assist; and/or manually applied force as a downstroke on the piston shaft handle. Valves featured with the invention include: bi-valvular flap; duck-bill; rotary and/or shuttle valves. The flap valve or duck-bill is favored as it entails no manipulation by the pump operator. The intake (or uptake) valving is connected to a suction line that depends downwardly into the storage unit. It is stopper- or plug-secured to the storage unit in order to fix its desired vertical posture; but as seen throughout the art, the storage unit must be vented since the pump works (partially) on a siphon principle. The outflow/exhaust valve is coupled to a discharge conduit which may connect to a fluid entrainment apparatus, also common in the art, or vent directly to the water pool or reservoir being chlorinated.

The fluid transfer process is begun by attaching the invention to a portable storage unit, generally a five-gallon carboy or container of chlorine liquid. A manual upstroke on the piston will fill the cylinder to a desired (measurable) level as indicated on the cylinder. Then, the operator releases the handle and, in the case of a gravity or spring assisted outflow using an automatically functioning valve, the chlorine fluid is metered to the discharge line. The fluid thereafter enters a fluid entrainment subassembly or is directed to the pool/reservoir.

DETAILED DESCRIPTION OF THE PREFERRED EMBODIMENT

The concepts of liquid transfer, as well as methods of venting, sealing and, in general, plumbing are well established and the art is regulary classified as a trade rather than a science. Therefore, the minutae of the instant invention will, at times, be ignored in this description. I have not the intention of secrecy; I simply do not wish to burden the reader with details that are within the tradesman's province to provide and are adequately described in the incorporated references.

Figure 1:
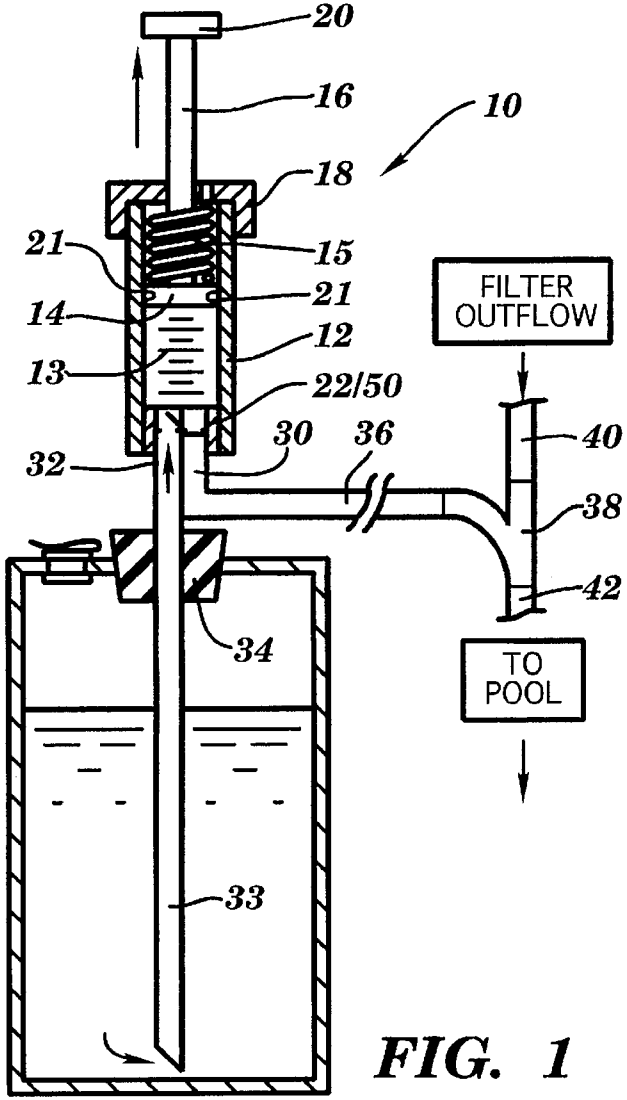
FIG. 1 is an elevational illustration of the invention.

Referring to FIG. 1, the invention 10 is disclosed inserted at/in the top of a liquid container C. The principal parts of the invention are: the cylinder 12 that encloses or houses the piston 14 and its adjunct assembly, consisting in a piston shaft 16, handle 20 and associated seals 21; a cap 18 to afford top closure, but not an hermetic seal, to the cylinder 12; an optional coil spring 15 about the shaft 16, used to assist the piston's return towards the cylinder base; a check valve subassembly 22/50 which bears two (22/50) part mumbers, evidencing that more than one valving modality is available; outflow 30 and input (uptake) 32 conduits; and suction line 33. A discharge line 36 is adjunctive equipment as are the container C and the invention mounting plug 34 which secures the invention 10 structure to this liquid chlorine portable storage unit.

Also shown in FIG. 1 is an outflow entrainment device 38. This Y- or T- shaped conduit consists in an essentially straight tube that receives pool circulation flow, generally from the filter assembly via input line 40 and discharges it via confluence outflow line 42. The invention's discharge line 36 may be (optionally) connected, as shown, to the device 38 so that its discharged chlorine fluid is entrained and rendered confluent with filter outflow. The device 38 can be made for calibrated or metered flow, thus determining a rate that the chlorine liquid will be dispensed into the pool. If this is not desired, nor deemed critical, orifice(s) of the outflow 30 conduit may be varied so as to effect a coarse metering and line 36 may be simply run to the pool or reservoir being chlorinated.

Figure 3:
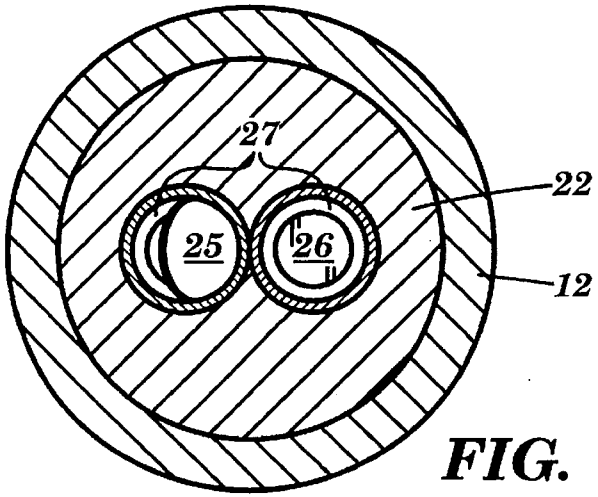
FIG. 3 is a sectionalized plan of the FIG. 2 device.
Figure 2:
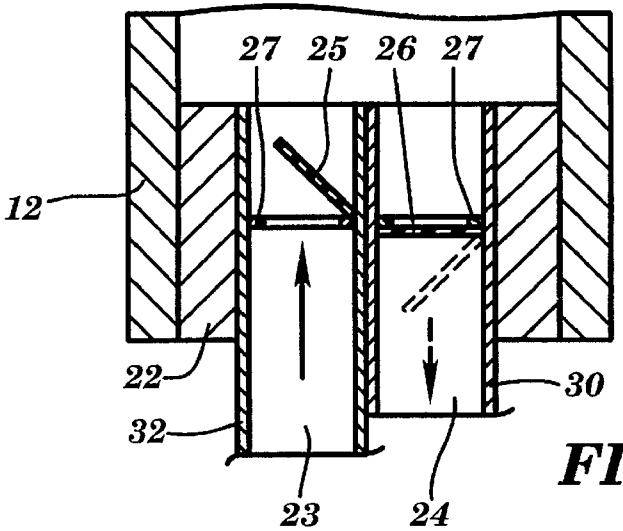
FIG. 2 is a sectionalized elevation of a check valve embodiment of the invention.

As mentioned in the SUMMARY etc., the operator, having connected the invention to the container C, assures that suction is present. This can be effected by several means known in the art; for instance, the piston may contain therethrough a bleed tube that is shut off after the pump is "primed" (not shown). Better still, if the embodiment disclosed at FIGS. 1–3 is employed, priming is just a matter of a few short strokes on the handle 20, until liquid begins to "bleed" into the cylinder through flap member 25 (FIG. 2). Once primed, a single upstroke on the handle is used to fill the cylinder to a desired level as indicated, reference being had to the volume indicia 13 shown on the cylinder. Once released, fluid will flow out of the cylinder by the various devices (including gravity) both named and claimed herein.

Referring particularly now to FIGS. 2 and 3, a preferred valve 22 embodiment is seen in sectionalized elevational and plan views. This flap valve subassembly functions automatically in that no actions, by the operator, on the valve mechanism per se are required. An upstroke of the piston 14 draws fluid through intake chamber 23, causing intake flap 25 to swing hingedly upward, and into the cylinder 12. On a downstroke valve 25 closes in the seat 27 and the weight/pressure of the fluid forces exhaust valve 26 downward, off the seat, allowing the fluid exit through outflow chamber 24. As described earlier, uptake 32 and outflow 30 conduits are fed by, or feed, suction line 33 and discharge line 36, respectively.

Figure 4:
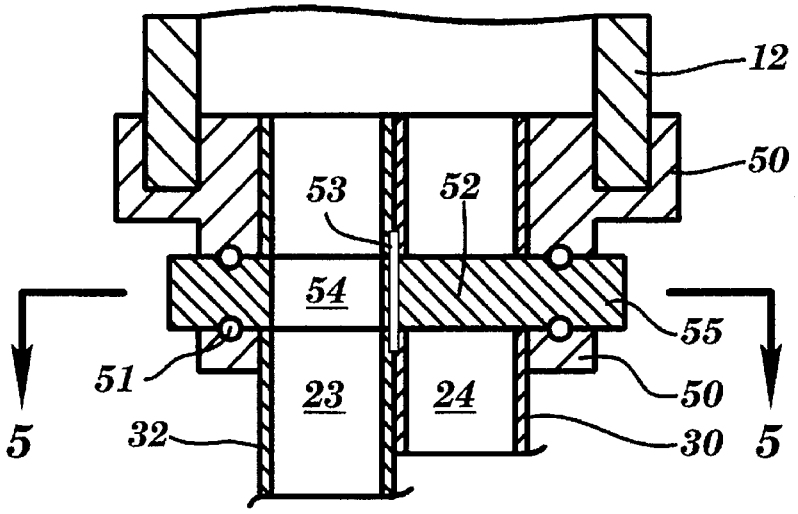
FIG. 4 is a sectionalized elevation of an alternate check valve embodiment.
Figure 5:
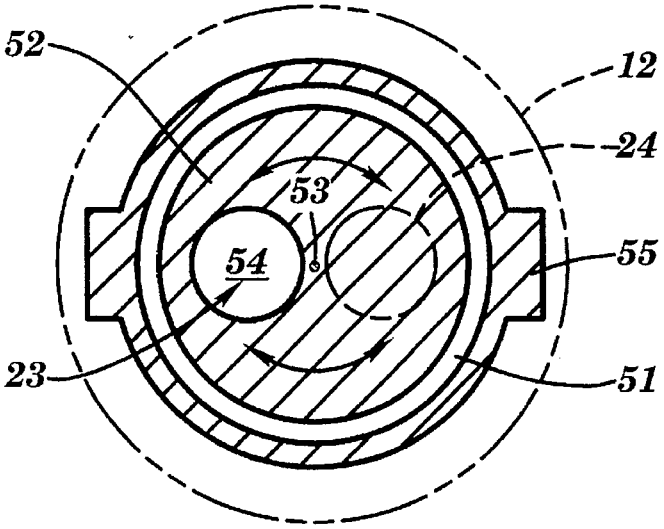
FIG. 5 is a sectionalized plan of the FIG. 4 embodiment.
Figure 6:
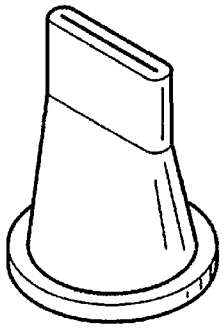
FIG. 6 PRIOR ART
FIG. 6 is an illustration of a prior art valve.

Alternate valve embodiment 50 is fairly disclosed in FIGS. 4 and 5. The reader is again advised that the representations given in FIGS. 1–5 are coarse and do not constitute drawings of fabrication or assembly stature. Further, those of ordinary skill are knowledgable of many valving mechanisms that work as well as flap valves, e.g., collapsible stem valves, such as a rubber balloon stem, also termed a "duck-bill" check valve; rotary valves, such as stopcocks or globe valves; and shuttle valves, such as depicted in incorporated (reference) U.S. Pat. No. 4,732,503, that are manually actuated by twisting, turning or depressing a detent/button. Thus FIGS. 4 and 5 merely typify a rotary valve embodiment not too different than that seen in the other incorporated references. Essentially, a valve body 50 appears bi-parted with a single port 54 disc 52 interposed between parts. The body and disc are coaxially (53) joined to allow disc rotation (thus angular translation of disc 52) between the body 50 parts. In FIG. 4, O-ring seals 51 are shown as typically used. Other O-rings (not shown) are used, in this scheme, interposed these same parts but about the axle 53. Instead of automatic action, as evident in flap valve 22 (or a duck-bill valve of FIG. 6), rotary valve 50 must be manually actuated by manipulative rotation of projections 55. This allows port 54 to be aligned coaxially with chamber 23, on uptake, and chamber 24, on exhaust or outflow.

A shuttle valve (not shown) of one translatable port will function analogous to the rotary, just as a duck-bill valve will mimic flap valve operation.

Having set forth the basic concepts of my invention, as well as having provided an apparatus for accomplishing conceptual goals, I commend it to the field for usage and refinement consistent with the following claims.

What is claimed is:

1. A fluid pump system for translating liquid in measured quantity from a lower reservoir to a liquid entrainment assembly comprising in combination:

a cylinder member having a vented top cIosure and a bottom-disposed singular valve mechanism that is wholly contained in said cylinder, said valve mechanism including an inlet means for communicating with the cylinder member outlet means, a lower reservoir suction line and a discharge line, said valve mechanism configured to pass liquid up from the reservoir into the cylinder member and to allow said liquid to drain therefrom;

a piston member slidingly disposed in the cylinder member for reciprocative movement between said top closure and the bottom valve mechanism, said piston member depending from a shaft that slidingly passes through said top closure; and, a coil spring disposed about said shaft between said piston member and said top closure, said discharge line disposed so as to feed said liquid to a location that is below said reservoir to connect with and join a filtered liquid flow by means of an entrainment device.

2. The system of claim 1 wherein said valve mechanism uses a duck-bill valve to pass said liquid upward.

3. The system of claim 1 wherein said singular valve mechanism further comprises a single-port, movable member that is rotatably transportable between said inlet means and said outlet means, the single port of said movable member being alternately alignable with each said inlet means and said outlet means.

4. The system of claim 1 wherein said singular valve mechanism comprises a first flap unit disposed between said cylinder member and said inlet means and a second flap unit disposed between said outlet means and said discharge line.

5. The system of claim 1 wherein said valve mechanism comprises a translatable plug means that is reciprocatively disposed therein and positionable to effect a first inlet open/outlet closed position and second inlet closed/outlet open position.

6. The valve mechanism of claim 1 in which said mechanism is a rotary valve assembly comprising an axially mounted member having a single through-chamber that is superimposed on and is 360-degree rotatably communicable with either said inlet means or said outlet means.

7. A portable, manually-operable pump combination for transferring fluid in a measured amount from a lower storage means to a desired location that provides a fluid-entraining liquid flow comprising:

a hand operable and removably fixable suction generating and temporary holding means that includes a cylinder, a reciprocative downwardly-biased piston and a biasing spring, for lifting said fluid from said lower storage means, to which said suction generating and temporary holding means is detachably secured, for measuring an amount of fluid so lifted and urging said amount or fluid out from said temporary holding means;

a single valve means contained wholly within and disposed at the bottom of said suction generating and holding means for directing fluid flow thereinto and thereout to a first downwardly depending conduit connecting with an evacuation-assisting fluid entrainment means, said fluid entrainment means being a connection device for confluencing the fluid flow with a liquid flow, said valve means providing an abutting stop to downward travel of the piston thereby effecting complete disbursement of the fluid out of the cylinder in said measured amount, said single valve means having an outlet; and a second downwardly depending conduit for communicating with the storage means and an inlet means of said valve means.

8. The combination of claim 7 wherein the storage means is a portable fluid container sealingly connected to said suction generating and holding means with said conduit, said conduit being disposed predominantly in the storage means, which storage means provides a sole physical support for the combination.

9. The combination of claim 8 wherein said valve means employs a flap assembly.

10. The combination of claim 8 wherein said valve means comprises a fluid valve that includes a single port adapted for 360-degree rotatable communication with either said inlet means or said outlet means.

11. The combination of claim 7 wherein said biasing spring further comprises a coil spring of resilient material disposed about a piston shaft of the pump and between a top closure means of the cylinder and said piston.

12. A measuring and fluid transfer assembly comprising:

a hand operable pump having a vertically oriented piston, including a spring means for biasing said piston, the piston disposed to reciprocate upwardly and downwardly within an at least partially transparent cylinder on a shaft that passes through a vented top closure of the pump, said spring means disposed about the shaft between the piston and said top closure;

a single check valve means disposed wholly within and at the bottom of said pump, the check valve means having adjacent uptake and discharge ports, in a single body that acts as a stop to downward travel of the piston, and communicating with a suction line for drawing liquid up into the pump; and said suction line depending downward from said valve means and bearing therabout a stopper means for insertingly sealing said line to a fluid container.

13. The assembly of claim 12 wherein said check valve means is a rotary valve subassembly comprising a single-holed disc superimposed on a two-holed disc.

14. The assembly of claim 12 wherein said check valve means is a flap valve comprising two ports, each of said ports bearing a flap device.

* * * * *